United States Patent [19]

Charles et al.

[11] 4,120,377

[45] Oct. 17, 1978

[54] TREE-CLIMBING KIT

[76] Inventors: Edward David Charles; Edward H. Charles, both of Rte. 2, Box 251, Creal Springs, Ill. 62922

[21] Appl. No.: 809,063

[22] Filed: Jun. 22, 1977

[51] Int. Cl.[2] ..... A63B 27/00; E06C 5/36

[52] U.S. Cl. ..... 182/3; 182/50; 182/135; 182/196

[58] Field of Search ..... 182/50, 133, 134, 135, 182/136, 3, 8, 196, 197

[56] References Cited

U.S. PATENT DOCUMENTS

| | | | |
|---|---|---|---|
| 148,744 | 3/1874 | Parent | 182/8 |
| 278,820 | 6/1883 | Reese | 182/50 |
| 1,486,289 | 3/1924 | Green | 182/197 |
| 2,836,335 | 5/1958 | Schuman | 182/134 |
| 2,886,227 | 5/1959 | Rose | 182/8 |
| 3,216,030 | 11/1965 | Garfield | 182/196 |
| 3,658,151 | 4/1972 | Wisdom | 182/135 |

FOREIGN PATENT DOCUMENTS

| | | | |
|---|---|---|---|
| 1,202,857 | 7/1960 | France | 182/133 |
| 414,423 | 12/1966 | Switzerland | 182/196 |

*Primary Examiner*—Reinaldo P. Machado
*Attorney, Agent, or Firm*—Ralph F. Staubly

[57] ABSTRACT

A tree-climbing kit comprises basically a piece of rope whose central portion has a plurality of closely spaced rings or loops fixed thereto or formed therein, and a pair of stirrups supported from hooks engageable alternately and sequentially in the rings or loops when the rope is double-hung from a tree limb and its ends are securely tied to the tree trunk. The kit also desirably includes a safety belt, and a spool-carried light-gauge pilot line with an end-attached weight for throwing and pulling over the tree limb over which the rope is to be pulled by the line.

11 Claims, 9 Drawing Figures

TREE-CLIMBING KIT

BACKGROUND AND OBJECTS OF THE INVENTION

Ropes specially adapted for climbing by stepwise-engageable stirrups are known (e.g. the fire escape of Philbrook U.S. Pat. No. 195,161 and the painter's seat of Rodde U.S. Pat. No. 716,109), but none is known which is particularly adapted for tree climbing and which can be easily set-up from ground level.

It is accordingly the principal object of this invention to provide a simple, inexpensive, safe and reliable tree-climbing kit that can be easily set-up from ground level. Other objects and advantages will become apparent as the following detailed description proceeds.

BRIEF DESCRIPTION OF THE DRAWINGS

With reference now to the drawings, the numeral 11 designates the rope constituting the basic element of the ladder-like member of the kit. Since a cable, chain, or woven belt, etc., could be substituted for the "rope", said term should herein be construed to embrace its obvious equivalents. In FIGS. 1 and 2 a large extent of the medial portion of the rope 11 has fixed thereto, at closely spaced intervals, a plurality of hook-receiving rings 13 formed of any suitable strong material, such as non-brittle molded fiber-reinforced plastics, woven or twisted fibers, metallic alloys, etc. The rings 13 can be fastened to the rope 11 in any suitable manner, e.g. by the several turns of cord or wire 15 tied as shown in FIG. 2.

In FIG. 1, the ring-free end of the rope 11 is shown as wrapped several turns around the lower part of the trunk of the tree T and then as hooked into a C-shaped element 17 tied to the end of the rope 11. From the element 17 the ring-carrying left reach of the rope 11 extends upwardly over a limb L of the tree T and then downwardly as the right reach of the ladder-like climber device. The right reach ends where the rope 11 again passes through the element 17 before being pulled taut and then tied to another C-shaped element 19 as shown in FIG. 4 (in which figure a second safety tying of the doubled rope 11 is shown at 11*s*). Each of the C-shaped elements 17 and 19 may have a conventional gap-closing spring finger 21 for safer rope retention.

FIG. 5 shows one of the pair of climbing members 23 (shown in phantom in FIG. 1), each comprising basically a triangular metal or reinforced-plastic stirrup 25, a ring-engaging hook 27, and their interconnecting cord, cable or chain 29 of approximately adult-height length. Preferably the stirrup 25 has attached thereto an elastic strip 31 to fit behind the heel of the user to prevent accidental slipping of the foot from the stirrup 25. Also desirably an elastic wrist band 33 is tied to the cord 29 adjacent the hook 27 to prevent accidential dropping of the hook.

FIG. 6 discloses a safety belt 35 which the kit desirably includes. It comprises two belt straps 37 and 39 interconnected by a size-adjusting rear buckle 41, and a snap-connecting front buckle 43. A pair of safety cords 45 are fixed to the front of the belt 35 and are length-adjustably connected with ring-engaging hooks 47 by adjusting buckles 49 of known construction.

FIG. 7 shows the pilot-line part of the kit. It comprises a spool 51 having a hand grip 53, a light-gauge strong line 55, a spring-finger-closed hook 56 and a fishing-sinker-type weight 57 for throwing over a tree limb (L in FIG. 1) to pull the line 55 thereover to serve as the pilot line for pulling one end of the rope 11 over the limb.

FIGS. 8 and 9 disclose an alternative method of forming the FIG. 1 structure, by forming hook-engageable loops 59 in the rope 11'. The loops 59 are formed by crimping split metal bands 61 over the adjacent reaches of the rope 11'. For extra strength a thermosetting or catalytic-setting cement 63 (FIG. 9) can be injected into the sleeve 61 through its slit or at its ends and into intercementing contact with the adjacent reaches of the rope 11'.

Figure 1:
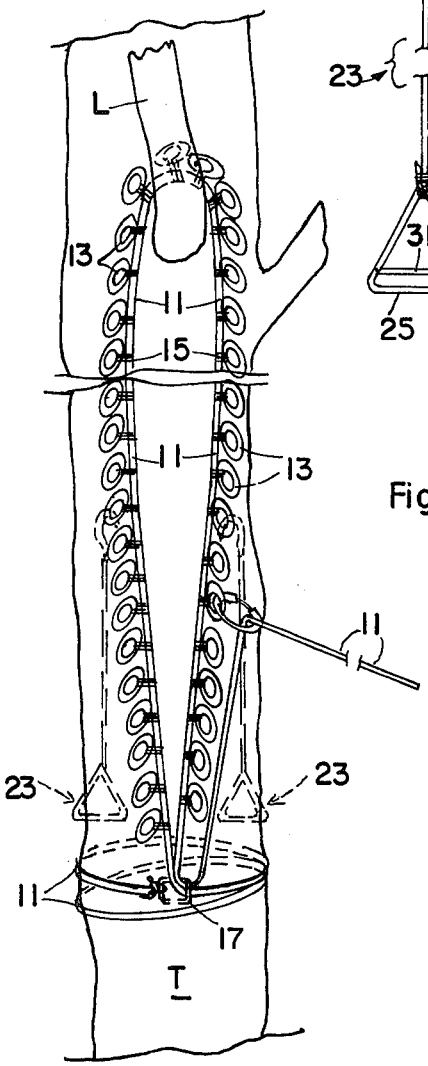
FIG. 1 is an elevational view of a typical set-up.
Figure 5:
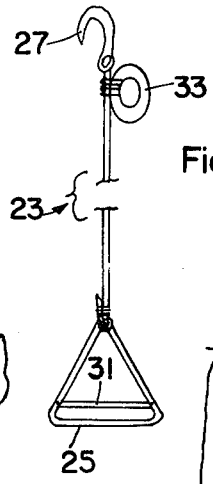
FIG. 5 is an elevational view of one stirrup.
Figure 3:
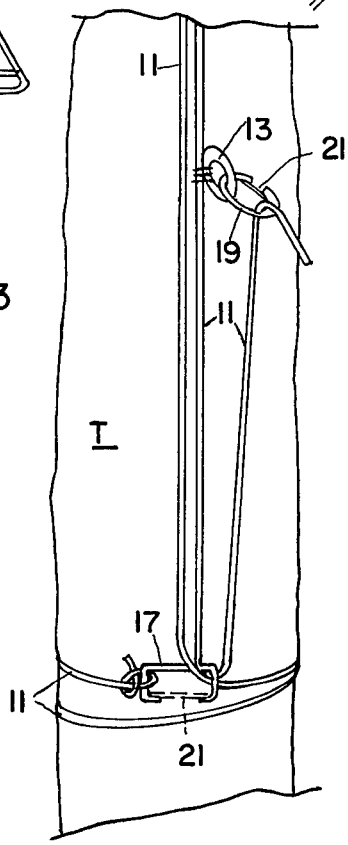
FIG. 3 is an enlarged fragmentary view of the lower half of FIG. 1 with the rings omitted for clarity.
Figure 4:
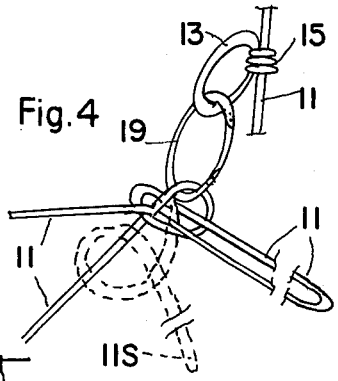
FIG. 4 is an enlarged fragmentary elevational view showing the rope-end-tying operation.
Figure 6:
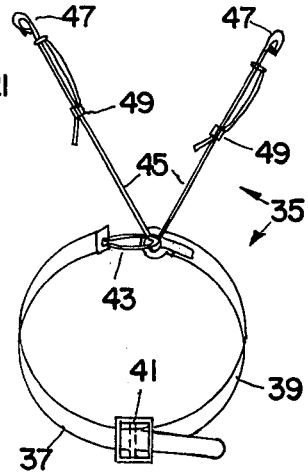
FIG. 6 is a perspective elevational view of a safety belt for the kit.
Figure 9:
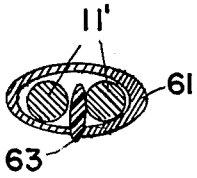
FIG. 9 is a plan view of the rope-loop-forming split ring of FIG. 8 in section taken on the line 9—9 of FIG. 8.
Figure 2:
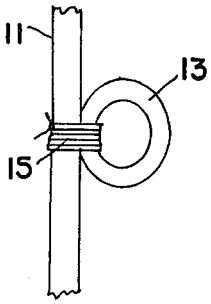
FIG. 2 is an enlarged fragmentary elevational view of a tied-on stirrup-supporting ring.
Figure 8:
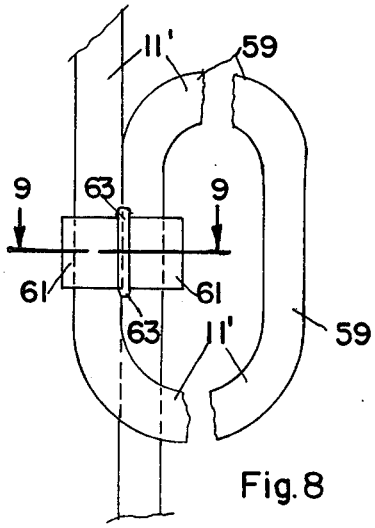
FIG. 8 is an enlarged fragmentary view of a modified form of rope having integral loops formed therein.
Figure 7:
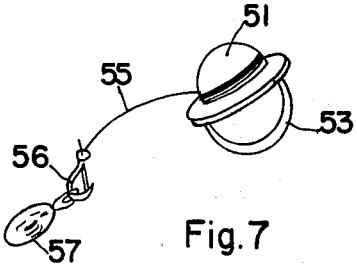
FIG. 7 is a perspective view of a hand-spool-carried weighted throw-line for pulling the rope over a tree limb.

Another very simple method of forming the loops would be to tie hangman's knots (not shown) in the rope at the desired spacings.

The invention having been described, what is claimed as being new and patentable is:

1. A tree-climbing device comprising: an elongated slender flexible element of a length exceeding twice the anticipated climb limit and of a tensile strength exceeding the expected maximum weight of a climber; a plurality of hook-receiving loops attached to said element at climbing-step-spaced intervals along a medial portion of said element; a pair of climbing members of roughly average-adult-human-body length, each having a stirrup at its lower end and a loop-engaging hook at its upper end; and means for firmly fastening the end portions of said element low on the trunk of said tree after said element has been draped over the base of a limb, said last-mentioned means comprising a first hook-ended rigid element fixed to one end of said flexible element and a second hook-ended rigid element attachable to one of said loops, both of said elements being adapted to receive loop-free end portions of said flexible element in fastening it to said tree trunk.

2. Structure according to claim 1, said loops being permanently attached pre-formed rings.

3. Structure according to claim 1, said loops being integral portions of said flexible element.

4. Structure according to claim 3, said loops being formed by tying hangman's knots in said flexible element.

5. Structure according to claim 3, said loops being formed by split metal-bonds deformably clamped over contiguous loop-completing portions of said flexible element.

6. Structure according to claim 1 and additionally comprising an elastic wrist-band attached to each climbing member adjacent its loop-engaging hook to prevent accidental dropping of said member.

7. Structure according to claim 6 and additionally comprising an elastic strip bridging each stirrup for engagement behind the heel of a user to prevent accidental disengagement of said stirrup.

8. Structure according to claim 1 and additionally comprising an elastic strip bridging each stirrup for engagement behind the heel of a user to prevent accidental disengagement of said stirrup.

9. Structure according to claim 1 and additionally comprising an adjustable-girth safety belt having a pair of loop-engaging hooks connected thereto by adjustable-length nonrigid elements.

10. Structure according to claim 1, and additionally comprising a weighted-end spool-carried throwable pilot line.

11. Structure according to claim 1, said hook-ended rigid elements being C-shaped.

* * * * *